US005102025A

United States Patent [19]

Weldele

[11] Patent Number: 5,102,025

[45] Date of Patent: Apr. 7, 1992

[54] COMPUTER TRACTOR RAIL PAPER MARGIN STRIPPER

[76] Inventor: Gary Weldele, 2024 Britton Dr., Long Beach, Calif. 90815

[21] Appl. No.: 443,894

[22] Filed: Dec. 1, 1989

[51] Int. Cl.[5] ..... B26F 3/02

[52] U.S. Cl. ..... 225/1; 225/106

[58] Field of Search ..... 225/1, 93, 91, 101, 225/106; 83/167; 269/216, 91, 289 R, 308

[56] References Cited

U.S. PATENT DOCUMENTS

| | | | |
|---|---|---|---|
| 568,400 | 9/1896 | Blanchard | 225/91 |
| 2,600.041 | 6/1952 | Wright | 225/101 |
| 2,711,793 | 6/1955 | Zalkind | 225/101 |
| 2,915,234 | 12/1959 | Zalkind | 225/101 |
| 3,036,751 | 5/1962 | Bartschi | 225/106 |
| 3,190,516 | 5/1964 | Eriksen | 225/101 |
| 4,529,113 | 7/1985 | Elliott | 225/1 |
| 4,657,163 | 4/1989 | Cats | 225/106 |
| 4,754,676 | 7/1990 | Wessels | 83/167 |
| 5,007,571 | 4/1991 | Nasby et al. | 225/106 |

OTHER PUBLICATIONS

Miles Kimbal Company Business Catalog "Pin Feed Margin Remover" Product N-9157-5, p. 1, publication date unknown.

*Primary Examiner*—Hien H. Phan

*Attorney, Agent, or Firm*—Howard A. Kenyon

[57] ABSTRACT

A device to tear the perforated margins off of a stack of computer paper is described. The device has a base which contains a waste receptacle in one embodiment that will catch the removed margins. The device uses a lower and upper elastic rib in one embodiment and a lower elastic rib only in another embodiment. The clamping mechanism is pivotal and the design is such that a given force on the handle will provide a greater than the given force clamping the paper margins. The clamping mechanism is either activated by hand or by power means, preferably an electric solenoid.

29 Claims, 3 Drawing Sheets

COMPUTER TRACTOR RAIL PAPER MARGIN STRIPPER

BACKGROUND OF THE INVENTION

1. Field of the Invention

This invention relates generally to a margin stripper of computer tractor rail paper and more specifically to a computer tractor rail paper margin stripper that can apply a multiple of force to the margin and also contains a waste receptacle.

2. Description of the Prior Art

Some printers employ a tractor rail that feeds continuously whereby a sprocket which engages holes provided in the edge margins of the paper. After printing, it is desirable to remove the perforated margins of the finished document. This is done by tearing the margins off of the paper along the perforations which is a weakened line.

Tearing the margins off by hand can be a laborious chore. One usually places a ruler along the perforated line and tears off the margins a few at a time. Although there are power devices that are available to strip the margins off of computer paper, they are expensive and can be afforded only by large firms.

There are several more non-powered devices available for an individual to tear off the margins of computer paper. U.S. Pat. No. 4,529,113 describes a device that is designed like a large hinge. A bar fitted on the bottom half of the hinge allows one to put a stack of paper between the hinge and press down with their body weight and tear off the margins. A rubber hose between the hinge halves separates the hinge when released. The torn off margin must be picked up and dispose of.

U.S. Pat. No. 4,657,163 describes a device similar to U.S. Pat. No. 4,529,113 except the device contains pins whereby the holes must be fitted on the pins. This takes time if the holes are not exactly aligned. Again, the torn off margin must be disposed of after being torn off. There are other patents such as U.S. Pat. No. 568,400 that describes a device for cutting show tickets. U.S. Pat. No. 3,190,516 relates to a paper bursting device for severing multiple office forms such as the ones with interleafed carbon paper.

The present invention incorporates leverage means to place a force on the margin greater than the force applied to the handle. None of the above devices uses means to apply a multiple force. The present invention also has a waste receptacle underneath the device to catch the torn off margin. All other non-powered devices require that the operator pull out the torn off margin and dispose of it before the next stack of computer paper can be inserted. The weight of the bottom rib and the lightness of the handle, combined, allow the torn off margin to fall into the waste receptacle as soon as the handle is released.

In one embodiment, power means is used to clamp the margin stack and hold the margin stack in place while the switch is activated. The preferred power means in the present invention is electrical power which activates a solenoid that is spring biased to return the solenoid to a released position when the switch is deactivated.

SUMMARY OF THE INVENTION

It is the primary object of the invention to provide a device for removing the perforated margin of a stack of computer tractor rail paper.

It is another object of the invention to provide a leveraged force to clamp the perforated margins.

It is yet another object of the invention to provide a waste receptacle to catch the torn off margins.

It is still another object of the invention to provide power means to clamp and hold the margins of the computer tractor rail paper.

Briefly, in accordance with the invention, there is provided a device for removing the perforated margin of a stack of computer tractor rail paper. The present device has a leveraged force that allows a force on the margins greater than the force applied to the handle. A removable waste receptacle is also incorporated in the device base that catches the disposed margins.

Other objects and advantages will become apparent from the following description and appended claims taken in conjunction with the accompanying drawings.

The novel features which are believed to be characteristic of the invention as to the system together with further objects and advantages thereof, will be better understood from the following description in connection with the accompanying drawings in which the presently preferred embodiment of the invention is illustrated by way of example. It is to be expressly understood, however, that the drawings are for purposes of illustration and description only, and are not intended as a definition of the limits of the invention.

DETAILED DESCRIPTION OF THE PREFERRED EMBODIMENT

Figure 1:
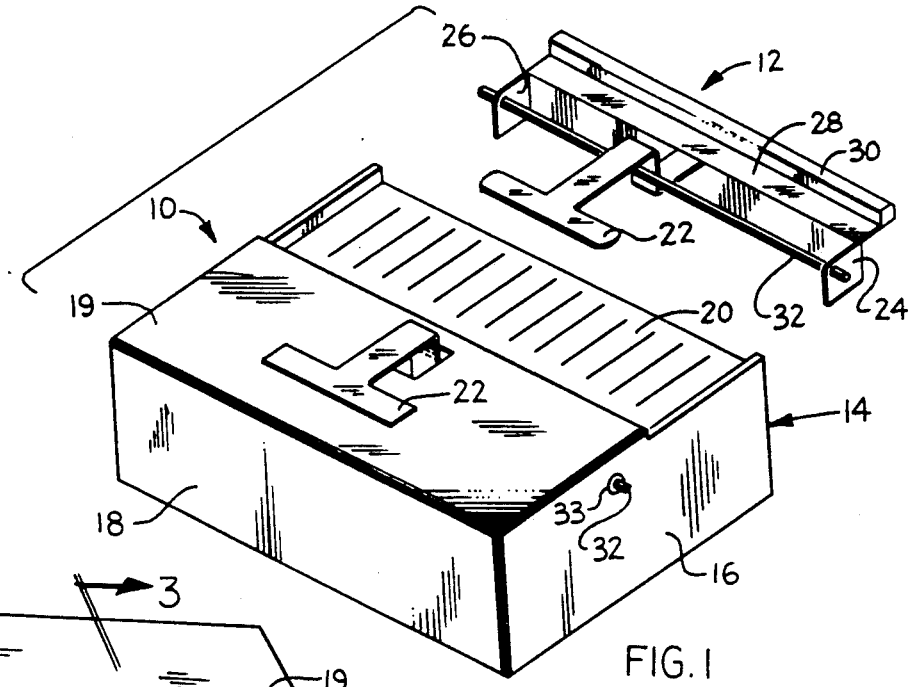
FIG. 1 is a perspective view of the base with the clamping mechanism removed and also shown in perspective.

Turning now to FIG. 1 there is shown a perspective view of the computer tractor rail paper margin stripper generally shown as 10. The clamping mechanism generally shown as 12 is removed from the stripper base 14 and is also shown in perspective view. The base 14 consists of a box, preferably made of plastic, with end 16 and back 18 and top 19. FIG. 1 also shows a paper glide surface 20 to accept a stack of computer tractor paper for the margins to be removed. FIG. 1 also shows a perspective view of the clamping mechanism which consists of a handle 22, side member 24 and 26, angle member 28 and lower rib 30. The side members 24 and 26 are metal and are joined to each end of the metal angle member 28. The lower rib 30, which is preferably made from an elastic material, is bonded to the face of the angle member 28. A metal pivot bar 32 is placed in the hole 33 of side members 24 and 26 with the ends extending therethrough. The metal bar 32 is shown extending through the side of the base 16. In this manner, the bar 32 provides pivotal means for the clamping mechanism 12.

Figure 2:
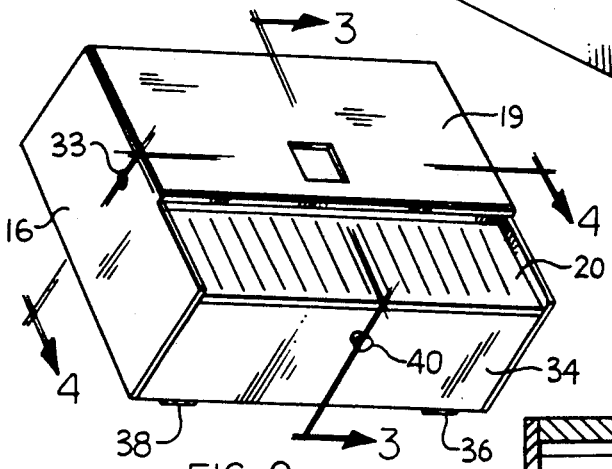
FIG. 2 shows a perspective view of the base without the clamping mechanism.

FIG. 2 shows a perspective view of the base 14 without the clamping mechanism 12. This view shows top 19, paper glide surface 20 and right side 16. Also in this view there is seen a door 34 to open to a waste containment area inside of base 14. The door 34 has hinges 36 and 38 along with knob 40. A magnetic catch (not shown) is used to hold the door 34 closed. Door 40 may be a sliding door instead of a hinge door, however a hinge door is preferred.

Figure 3:
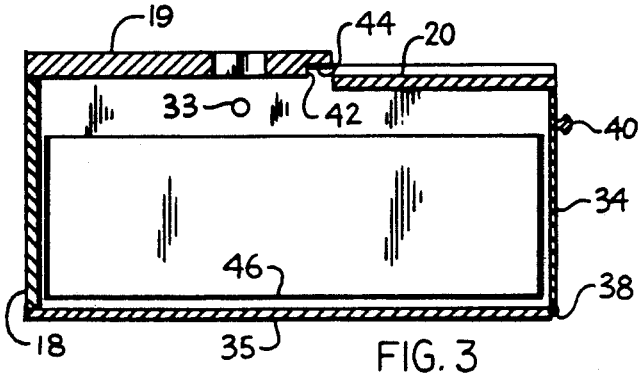
FIG. 3 is a sectional view of the base as shown in FIG. 2.

FIG. 3 is a cross section of a line drawn through the perspective drawing shown in FIG. 2. FIG. 3 shows the top of the base 19, the end 18, a base bottom 35, a door 34, knob 40, and hinge 38. The paper glide surface 20 holds the stack of computer paper (not shown) and the abutment 42 that stops the stack of computer paper at a predetermined distance where the clamping means holds the margins. Also shown in this view in one embodiment is an upper rib 44 that is bonded to the edge of top member 19. FIG. 3 also shows a removable waste receptacle 46 that fits inside base 10. Also seen is pivot hole 33 that receives metal pivot bar 32.

Figure 4:
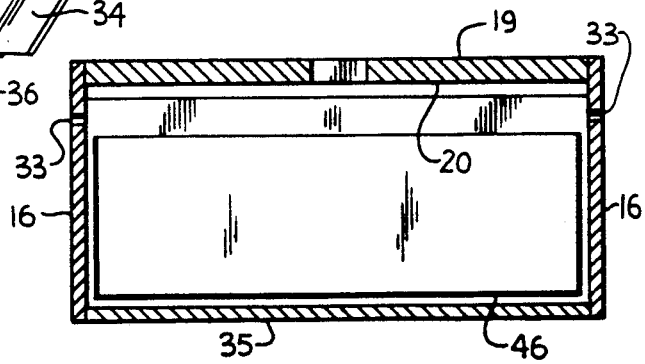
FIG. 4 is a sectional view of the base as shown in FIG. 3.

Turning now to FIG. 4 there is seen a cross section of a line drawn through the perspective drawing shown in FIG. 2. The top surface 19 of base 10 is shown along with paper glide surface 20. The base side 16 and bottom 35 is also shown. The waste receptacle 46 inside base 10 is also seen in FIG. 4.

Figure 5:
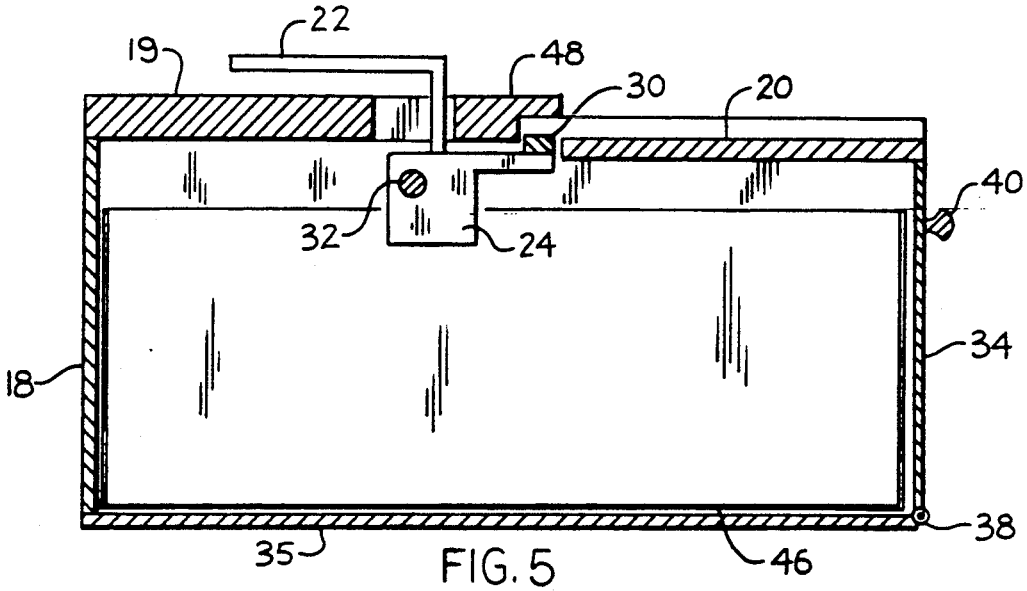
FIG. 5 is a cross section view of the base with the clamping mechanism installed.

FIG. 5 shows a partial cross section view of the base 10 with the clamping mechanism 12 in place. In this view the handle 22 and the end member 24 are not given in cross section as it is believed to be clearer as it is shown. This view shows paper glide surface 20, lower rib 30, pivot bar 32, base top 19, base back 18, base bottom 35 with door 34 having knob 40 and hinge 38. It is noted that there is no upper rib in this figure as the edge 48 of base top 19 is made from a hard material that provides an edge to shear the margins of the computer paper. Also seen in this view is waste receptacle 46.

Figure 6:
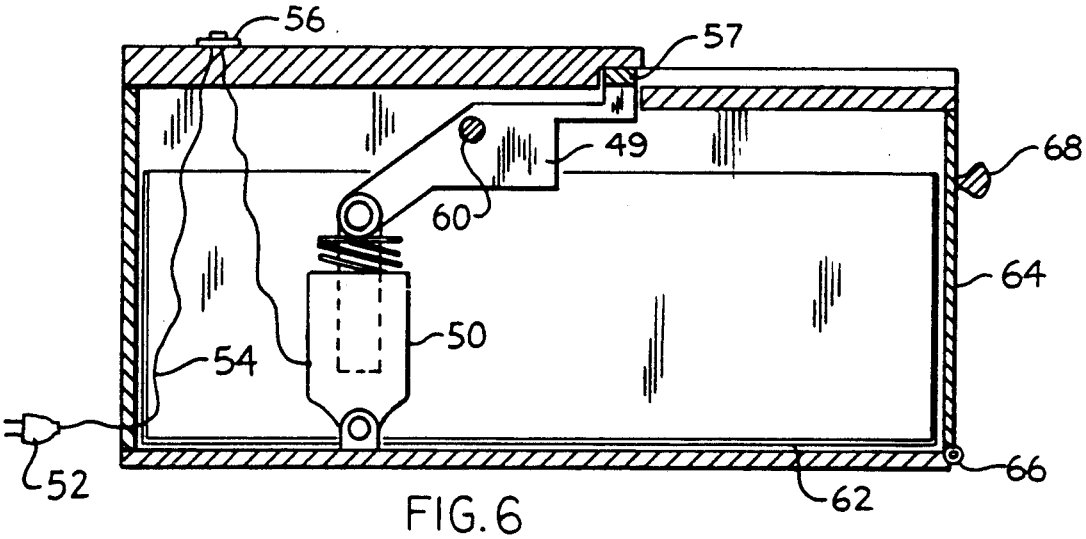
FIG. 6 is a cross section of the base with an electrical solenoid and a switch.

FIG. 6 shows a computer tractor rail paper margin stripper that has power means to activate the clamping mechanism 49. In this view the power means is an electrical solenoid 50. The electrical power is obtained through plug 52 and wire 54. A switch 56 provides electrical power through wire 58 to solenoid 50. The clamping mechanism pivots around pivot bar 60 and closes rib 57 on the paper margin (not shown). The solenoid is shown in its closed or activated position. Spring 62 is shown in its compressed position. When the electrical power is turned off by switch 56, spring 60 expands and opens the clamping mechanism. Also shown in this view is waste receptacle 62.

Figure 7:
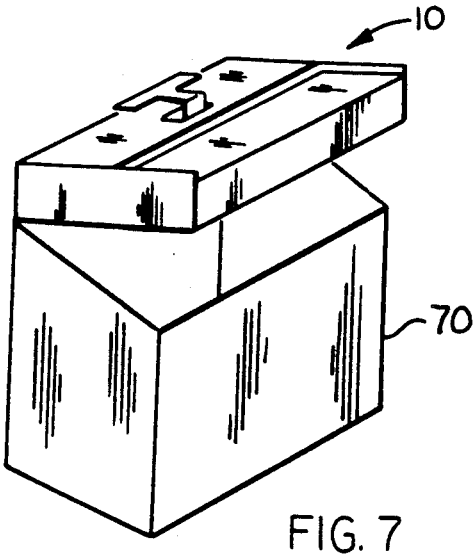
FIG. 7 is a perspective view of the base open on the bottom with a container to receive the computer paper removed margins.

FIG. 7 shows a computer tractor rail paper margin stripper 10 that contains no waste receptacle, has had the bottom removed and is placed over a square receptacle 70 to catch the stripped margins.

Figure 8:
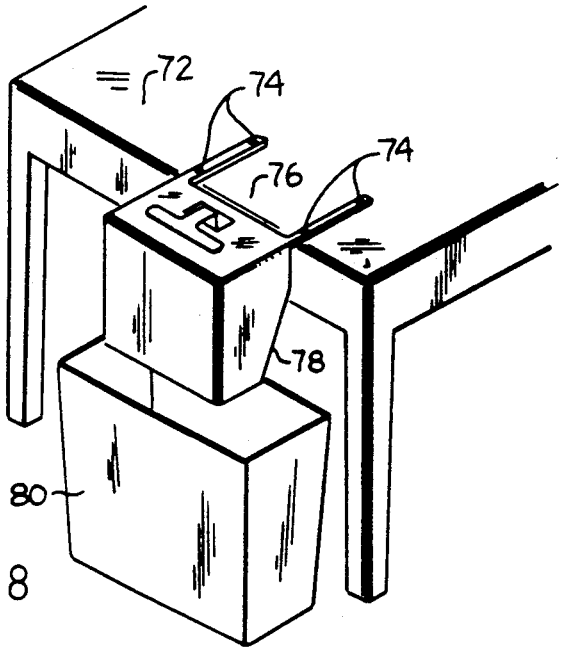
FIG. 8 is a perspective view of the margin stripper using a table as a paper glide surface.

FIG. 8 shows an embodiment whereby the margin stripper 10 is attached to a table 72 with fastening means 74. In FIG. 8 the fastening means 74 are threaded devices such as screws or bolts, however, fastening means may be two sided tape. FIG. 8 shows a portion of the table 72 as a paper glide surface 76. In this figure, the base has a sloping potion 78 on one side to form a chute to empty the detached margins into a waste container 80.

Figure 9:
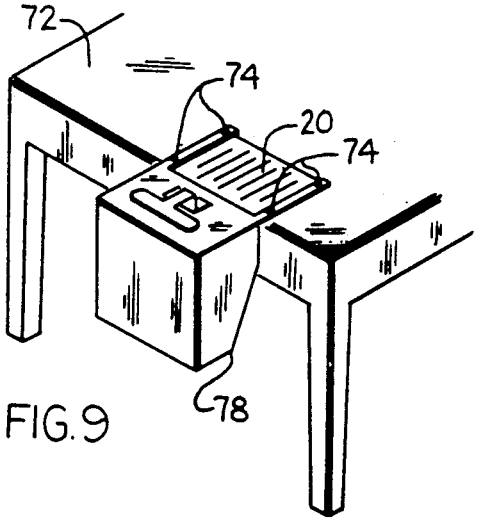
FIG. 9 is a perspective view of the margin stripper with the paper glide surface attached to the base.

FIG. 9 is the same as FIG. 8 except the paper glide surface 20 has been retained.

Figure 10:
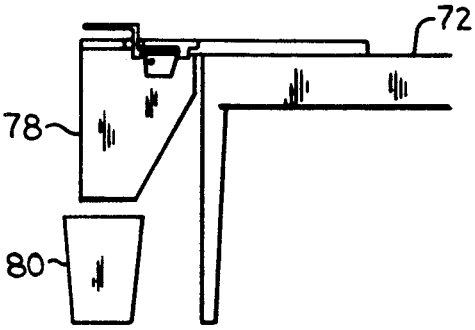
FIG. 10 is a side view showing the chute built into the base.

FIG. 10 show a side view cut away of the margin stripper of FIG. 8. This view shows how the chute directs the detached margins into the waste container 80.

Thus, it is apparent that there has been provided in accordance with this invention, a computer tractor rail paper margin stripper that fully satisfies the objectives, aims, and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives modifications, and variations that fall within the spirit and scope of the appended claims.

What is claimed is:

1. A method of removing the margins from a stack of edge driven, continuous feed, computer tractor rail paper, the margins being separated from the paper by a perforated line, comprising:

providing a rectangular base, said base having a top, a bottom, two length sides and two width sides, the top having a paper glide surface and an elongated edge, said edge being spaced from said paper glide surface and defining an opening for accepting margins of the stack of papers supported by said paper glide surface, said base having an internal removable waste receptacle;

providing an abutment on said base extending generally in the direction of the axis of said mounting means for engaging said margins of said stack and positioning said stack at a predetermined distance relative to said edge;

providing an upper elastic rectangular rib and a lower elastic rectangular rib;

providing activating means to activate and deactivate said upper and said lower ribs into said open and said closed position;

providing a mounting member comprising an angle member having a handle and said lower rib attached thereto and further having side members attached on each end of said angle member, a pivotal mechanism extending through said side members of said angle members and said width sides of said base to form a pivot axis for the lower rib, such that said upper rib and said lower rib provide a space therebetween in an open position for receiving the margins of a stack of paper and in a closed position said upper rib and said lower rib clamp the margins for tearing against said upper rib:

placing the margins of said stack between the upper and lower ribs against said abutment;

activating said activating means such that said margins of said stack are held firmly between the upper and lower ribs;

tearing said margins along said perforated lines; and deactivating said activating means whereby said margins are deposited in said waste receptacle.

2. A device for stripping the margins from a stack of edge driven, continuous feed, computer tractor rail paper, the margins being separated by a perforated line, said device comprising:

a rectangular base, said base having a top, a bottom, two length sides and two width sides, the top having a paper glide surface, and an elongated edge, said edge being spaced from said paper glide surface and defining an opening for accepting margins of the stack of paper supported by said paper glide surface;

an upper rib attached to the edge of the top of said base;

a lower rib;

mounting means in said base for mounting said lower rib for pivotal movement about an axis wherein said lower rib and said upper rib have a space therebetween in an open position for receiving the margins of a stack of paper and said lower rib and said upper rib, in a closed position, clamp the margins for tearing against said upper rib;

an abutment on said base extending generally in the direction of the axis of said mounting means for engaging the margins of said stack and positioning said stack at a predetermined distance relative to said edge;

activating means to activate and deactivate said upper and lower ribs into said open and said closed position, and;

removable waste containment means in said base.

3. A device as described in claim 2 wherein said mounting means comprises an angle member having a handle and said lower rib attached thereto and further having side members attached on each end of said angle member, said side members having a bar extending therethrough to form the pivot axis for the lower rib.

4. A device as described in claim 3 wherein said lower rib is located below the top of said base.

5. A device as described in claim 2 wherein said wherein said mounting means for the pivotal movement about said axis is a bar extending through the width sides of said base.

6. A device as described in claim 2 wherein said upper and lower ribs are generally rectangular in cross section and is composed of an elastic material.

7. A device as described in claim 2 wherein said waste containment means in said base is a removal waste receptacle that fits inside said base.

8. A device as described in claim 7 wherein said base has a hinged door to provide access to said waste receptacle.

9. A device for stripping the margins from a stack of edge driven, continuous feed, computer tractor rail paper, the margins being separated from the paper by a perforated line, said device comprising:

a rectangular base, said base having a top, a bottom, two length sides and two width sides, the top having a paper glide surface;

a hardened upper edge attached to the top of said base, said edge being spaced from said paper glide surface and defining an opening for accepting margins of the stack of paper supported by said paper glide surface;

a lower rib; mounting means in said base for mounting said lower rib for pivotal movement about an axis wherein said lower rib and said upper edge have a space therebetween in an open position for receiving the margins of a stack of paper and said lower rib and said upper edge, in a closed position, clamp the margins for tearing against said edge:

an abutment on said base extending generally in the direction of the axis of said mounting means for engaging the margins of said stack and positioning said stack at a predetermined distance relative to said edge;

activating means to activate and deactivate said hardened upper edge and said lower rib into said open and said closed position; and removable waste containment means in said base.

10. A device as described in claim 9 wherein said activating means having a handle extending through the top of said base for applying a force between said upper edge and said lower rib to clamp the margins for tearing against said edge.

11. A device as described in claim 9 wherein said mounting means comprises an angle member having an end extending through the top of said base to define said activating means and said lower rib attached thereto at another end, said angle member further having side members, said side members having a bar extending therethrough to form the pivot axis for the lower rib.

12. A device as described in claim 9 wherein said mounting means for the pivotal movement about said axis is a bar extending through the width sides of said base.

13. A device as described in claim 9 wherein said lower rib is rectangular in cross section and is composed of an elastic material.

14. A device as described in claim 9 wherein said bottom is removable and said device, with the bottom removed, is mounted over a rectangular trash receptacle to receive the separated margins of said computer tractor rail paper.

15. A device as described in claim 9 wherein said activating means to activate and deactivate said hardened upper edge and said lower rib is by power means.

16. A device as described in claim 15 wherein said power means is an electrical solenoid activated by a switch, said solenoid holding said lower rib and said upper edge in a closed position when activated and said solenoid having a spring release when said solenoid is deactivated.

17. A device for stripping the margins from a stack of edge driven, continuous feed, computer tractor rail paper, the margins being separated from the paper by a perforated line, said device comprising:

a rectangular base, said base having a top, an open bottom, two length sides and two width sides, the top having two extended arms, a paper glide surface and an elongated edge, said edge bring spaced from said paper glide surface and defining an opening for accepting margins of the stack of papers supported by said paper glide surface;

a hardened upper edge attached to the edge of the top of said base;

a lower rib;

mounting means in said base for mounting said lower rib for pivotal movement about an axis wherein said lower rib and said upper edge have a space therebetween in an open position for receiving the margins of a stack of paper and said lower rib and said upper edge, in a closed position, clamp the margins for tearing against said upper edge;

an abutment on said base extending generally in the direction of the axis of said mounting means for engaging the margins of said stack and positioning said stack at a predetermined distance relative to said edge;

activating means to activate and deactivate said hardened upper edge and said lower rib into said open and said closed position; and removable waste containment means in said base.

18. A device as described in claim 17 wherein said activating means having a handle extending through the top of said base for applying a force between said upper edge of said lower rib to clamp the margins for tearing against said upper edge.

19. A device as described in claim 17 wherein said mounting means comprises an angle member having an end extending through the top of said base to define said activating means and said lower rib attached thereto at another end, said angle member further having side members, said side members having a bar extending therethrough to form the pivot axis for the lower rib.

20. A device as described in claim 17 wherein said mounting means for the pivotal movement about said axis is a bar extending through the width sides of said base.

21. A device as described in claim 17 wherein said lower rib is rectangular in cross section and is composed of an elastic material.

22. A device as described in claim 17 further comprising a waste chute attached to said open bottom of said base, said waste chute having a bottom opening.

23. A device as described in claim 19 wherein the bottom opening of said waste chute is reduced in size.

24. A device as described in claim 17 wherein said two extended arms having fastening means for mounting the device to a table top.

25. A device as described in claim 24 wherein said table top is a paper glide surface.

26. A device as described in claim 24 wherein said fastening means are threaded fasteners.

27. A device as described in claim 24 wherein said fastening means is two sided tape.

28. A device as described in claim 17 wherein said activating means is activated by power means.

29. A device as described in claim 28 wherein said power means is an electrical solenoid activated by a switch, said solenoid holding said lower rib and said upper edge in a closed position when activated and said solenoid having a spring release when said solenoid is deactivated.

* * * * *